US007611304B2

(12) United States Patent
Lill et al.

(10) Patent No.: US 7,611,304 B2
(45) Date of Patent: Nov. 3, 2009

(54) CATCH BASIN CURB INLET COVER

(75) Inventors: Clifford F. Lill, Hawthorne, NJ (US); Kristopher J. Lill, Oakland, NJ (US)

(73) Assignee: Campbell ERS LLC, Harrison, NJ (US)

( * ) Notice: Subject to any disclaimer, the term of this patent is extended or adjusted under 35 U.S.C. 154(b) by 138 days.

(21) Appl. No.: 11/590,469

(22) Filed: Oct. 31, 2006

(65) Prior Publication Data

US 2007/0086856 A1 Apr. 19, 2007

Related U.S. Application Data

(63) Continuation-in-part of application No. 11/253,893, filed on Oct. 19, 2005, now Pat. No. 7,128,495.

(51) Int. Cl.
*E01D 5/00* (2006.01)

(52) U.S. Cl. ..... 404/4; 210/163

(58) Field of Classification Search ..... 404/2, 404/3, 4, 5; 210/163

See application file for complete search history.

(56) References Cited

U.S. PATENT DOCUMENTS 1,479,651 A * 1/1924 Clements ..... 404/6
4,594,157 A * 6/1986 McGowan ..... 210/163
7,052,602 B2 * 5/2006 Boggs et al. ..... 210/167.1
7,160,048 B1 * 1/2007 Fattori et al. ..... 404/4
7,179,371 B1 * 2/2007 Bistline ..... 210/163
7,234,894 B1 * 6/2007 Flury ..... 405/94
2004/0173513 A1 * 9/2004 Nino ..... 210/156
2004/0173517 A1 * 9/2004 Yuan ..... 210/416.1

OTHER PUBLICATIONS

US 7,399,417, 07/2008, Yuan (withdrawn)*

* cited by examiner

*Primary Examiner*—Gary S Hartmann
(74) *Attorney, Agent, or Firm*—W. Patrick Quast

(57) ABSTRACT

A catch basin curb inlet opening cover is a steel plate member which includes a main segment having at least one first opening whereby fluid may pass through said at least one first opening into the curb inlet opening when said plate member is positioned in its intended place, and a bend portion. The bend portion is formed from the main segment by deforming a respective section of the main segment. When in place across the curb inlet opening, the bend portion extends into the curb inlet opening. A respective surface of the bend portion is in sufficiently close proximity to either or both of the left edge or the right edge of the curb inlet opening so that the plate member will resist horizontal movement occasioned by being struck by a snow plow or other heavy duty street equipment. Adjusting means are described which adjust the length of the bend portion to accommodate different inlet openings. The main segment includes a further opening adapted to permit the viewing of a precautionary badge.

18 Claims, 15 Drawing Sheets

CATCH BASIN CURB INLET COVER

This application is a continuation in part of prior application Ser. No. 11/253,893, filed Oct. 19, 2005 now U.S. Pat. No. 7,128,495.

FIELD OF THE INVENTION

This invention refers generally to curb inlets for surface drainage and more particularly to a cover for a catch basin curb box.

BACKGROUND OF THE INVENTION

Description of the Prior Art

At the present time, catch basin curb boxes are employed along the length of thoroughfares in developed areas. These are set at prescribed distances to facilitate water run-off so as to prevent localized flooding, particularly aggravated by heavy downpours.

At the present time, the opening to the typical cast iron, catch basin curb box comes in a myriad of various contours. These contours vary from town to town and even within a particular town.

There has been thought of and proposed, various techniques, including various cover plate designs, which seek to restrict the passage of assorted debris material into the catch basin. Of major concern are cans and bottles which can cause havoc if they enter the storm sewer systems, resulting in increased costs for removal and possible equipment repairs and, of course, undesirable contamination of our rivers, lakes and streams.

At the same time a catch basin cover should not unnecessarily restrict the water flow rate into the catch basin. Various agencies, for example a State's Department of Transportation (DOT) set standards for acceptable flow rates for a catch basin and covers. These are set to ensure that the basin and/or cover openings do not contribute to a potential flooding problem by unduly restricting water flow while, in the case of the cover, they function to inhibit the passage of certain over-sized items.

So, for example, the DOT for the State of New Jersey requires that each of the openings for new catch basin designs and for retrofit catch basin covers cannot exceed 2.0 inches in the smallest dimension of the opening and is restricted to 7.0 square inches maximum in the overall area.

A particular water flow rate for the basin, with or without a cover, can be assured by allowing for a sufficient number of such holes so that, in fact, there is limited obstruction to the flow of water while still accomplishing the barrier requirements of DOT regulations.

As noted above the contours of the openings of these catch basins vary widely. So the dimensions of these holes have to vary to satisfy the DOT requirements while adapting to accommodate different basin contours. A cost efficient system and methodology to provide a practical solution for such a large number of contours is highly desirable. This can include a set of standard inlet covers which can handle a large percentage of the various contours. In addition, it is desirable that a curb inlet cover can be made to cover any one particular curb basin inlet opening.

If the curb inlet cover is to be mounted such that it's down-steam surface is juxtaposed to the outward facing of the curb basin inlet, a significant concern involves the potential problems which may occur with contact between the exposed cover and heavy road equipment including snow plows and street sweepers.

Another desirable feature of the present invention is that the curb inlet cover can be produced to include an opening through which can be displayed a precautionary badge which warns against actions that can lead to contamination of the water supply. Presently, these are adhered to one of the exterior surfaces of the catch basin or cover through the use of a strong bonding material. Of course, with time these bonds deteriorate and the badges have to be reattached or replaced. This is a labor intensive activity.

A preferable technique for manufacturing catch basins is the sand casting technique. Using this approach, the cast surfaces are often irregular unless a post-casting finishing procedure is employed. Preferably, at most, this finishing procedure is only implemented on the visible surface since it is an unnecessary, cost-wise, to do so on both sides. Thus the interior surface typically is highly irregular as is known in the art. In addition, the interior surface is oftentimes angled. These characteristics render the clamping of a cover plate to the catch basin problematic.

In U.S. Pat. No. 1,654,246, a grating or guard for a catch basin is described which includes a plurality of openings "which will exclude entry to the basin from the gutter of material of a size greater than can pass through the openings in the grating or guard . . . [for example] sticks, tin cans, and rags". This design describes a means for securing the grating to the opening which includes a "recess 41" in each side of the "curb 25". Each recess receives the free outer end of a spring 42. The latter snaps into its respective recess "in the act of pushing the grating or guard 36 into place." The "springs . . . [are] relatively strong so as to prevent the cover from being readily pulled out." Also, although "[t]he opening 37 in the curb is shown as made to correspond with the shape of the grating or guard illustrated in the drawings", "[i]t . . . [is] to be understood . . . that the grating or guard may take other forms."

Recently, the LMT Mercer Group of Lawrenceville, N.J., has brought to the market a catch basin cover made of thermoplastic and formed by an injection molding process. The cover is secured to the catch basin using a bracket, bolt and washer. The bracket includes a serrated portion and is positioned in a slot so as to allow for the grabbing of the adjacent catch basin area by the serrated section.

Also U.S. Pat. No. 505,130 discloses a removable locking grate section, U, which snugly fits within the open front of the curb box. A five-sided locking screw passes through a counter sunk opening in the grate and engages a threaded lug which is formed as part of the curb box. The specially configured locking screw can only be removed by authorized personnel.

U.S. Pat. No. 4,594,157 describes an inlet screen which is secured in the opening of the curb box using an F-shaped clamp.

United States Pub. No. US2004/0173513 describes a grid assembly including a grid member which is positioned at the curb inlet such that its "upstream" side is flush with the face of the curbside. There is no exposed portion of this grid assembly extending beyond the outward facing of the curb basin inlet. The grid is preferably made from "expanded metal" or "can be in the form of sheet metal with grid apertures punched out, a wire mesh, a grate, a screen, a filter, a strainer" or other "conventional form" (see ¶[0060]). This grid 22 "preferably is substantially rigid and able" ([see ¶[0058]). To achieve "a sufficiently strong and rigid grid" it is formed to include "a top rearward extended portion 23 and a bottom rearward extended portion 24." (See ¶[0058]). The grid is rotatably mounted in the curb inlet opening so that it may be periodically rotated to facilitate the disposal of debris which accumulates on its upstream surface.

While these designs afford a certain ability to protect against larger debris from entering the catch basin they have certain drawbacks. None of the described inventions which protrude beyond the outward facing front surface of the curb inlet address the serious issue of contact with heavy duty street equipment.

Therefore a primary object of this invention is to provide a cover for a catch basin curb inlet which is secured to the outward facing front surface of the inlet and which by design can be made to withstand the contact forces exerted by the heavy duty street equipment.

It is a further object of this invention to provide a cover for a catch basin curb inlet which will address the myriad numbers of opening contours associated with catch basins with a resulting, respective product which is practical and realistically priced.

A further object is to provide a product which can be confidently secured, even against the irregular, angled interior surface of most catch basin castings and which cannot be removed easily.

It is still a further object of this invention to provide a curb box cover assembly which installs in minutes over standard and custom-sized catch basin castings.

Yet another object is to provide a methodology which permits rapid production of a large and different array of cover plates for standard and custom sized catch basin curb boxes.

It is still another object to provide a steel product which will withstand the deleterious effects of time, weather and environs.

It is yet another object of the invention to provide a plate which will allow a precautionary badge to be viewed through a suitably sized opening and which will allow the affixation of the badge to the cove plate by welding it in place.

SUMMARY OF THE INVENTION

Towards the accomplishment of these and other objects and advantages, more of which will become apparent after a reading of the following specification and consideration of the accompanying drawings, there is disclosed a catch basin inlet opening cover. The curb inlet has an outward facing front surface and a prescribed area and contour dimensions. The opening includes a left edge, right edge and a top edge, the left edge disposed at a certain horizontal distance from the right edge.

The cover comprises a plate member which has a predetermined thickness, length and height. The plate member includes a first or up-water surface and a second or down-water surface parallel to the first surface and separated from the first surface by the predetermined thickness. The length and height of the plate member are of sufficient dimension such that the plate member extends beyond the left edge, right edge and top edge of the curb inlet opening so as to cover the entire area of the curb inlet opening when the plate member is positioned in its intended place in front of the curb inlet opening with the second surface juxtaposed to the outward facing front surface.

The plate member includes a main segment having at least one first opening whereby fluid may pass through the at least one first opening into the curb inlet opening when the plate member is positioned in its intended place.

The plate member includes a further segment secured to the main segment. This further segment extends into the curb inlet opening. The further segment is located on the main segment such that a respective surface of the further segment is in sufficiently close proximity to at least one of the group consisting of the left edge or the right edge of the contour of the curb inlet opening, whereby if the plate member is subjected to a force otherwise sufficient to horizontally displace the plate member when the plate member is in its intended place in front of the curb inlet opening with the second surface juxtaposed to the outward facing front surface, the plate member will resist horizontal movement due to the engagement of the respective surface of the further segment and the at least one of the group consisting of the left edge or the right edge of the contour of the curb inlet opening and remain substantially positioned in its intended place.

In the preferred embodiment, the further segment comprises a bend portion which is formed from the main segment by deforming a respective section of the main segment.

The main segment of the cover may include at least two stanchion segments for supporting the cover during the assembly of the cover to the catch basin.

The main segment may include a further opening. This further opening is adapted to permit the viewing of a precautionary badge when the precautionary badge is secured to the second or down-water surface of the plate member.

The cover may include further means for adjusting the horizontal length of the further segment so that the distance from the respective surface of the further segment to at least one of the group consisting of the left edge or the right edge of the contour of the curb inlet opening can be varied so as to enable the cover to be used with catch basin curb inlets having catch basin curb inlet openings of different prescribed areas and contour dimensions.

DESCRIPTION OF THE PREFERRED EMBODIMENT

Figure 1:
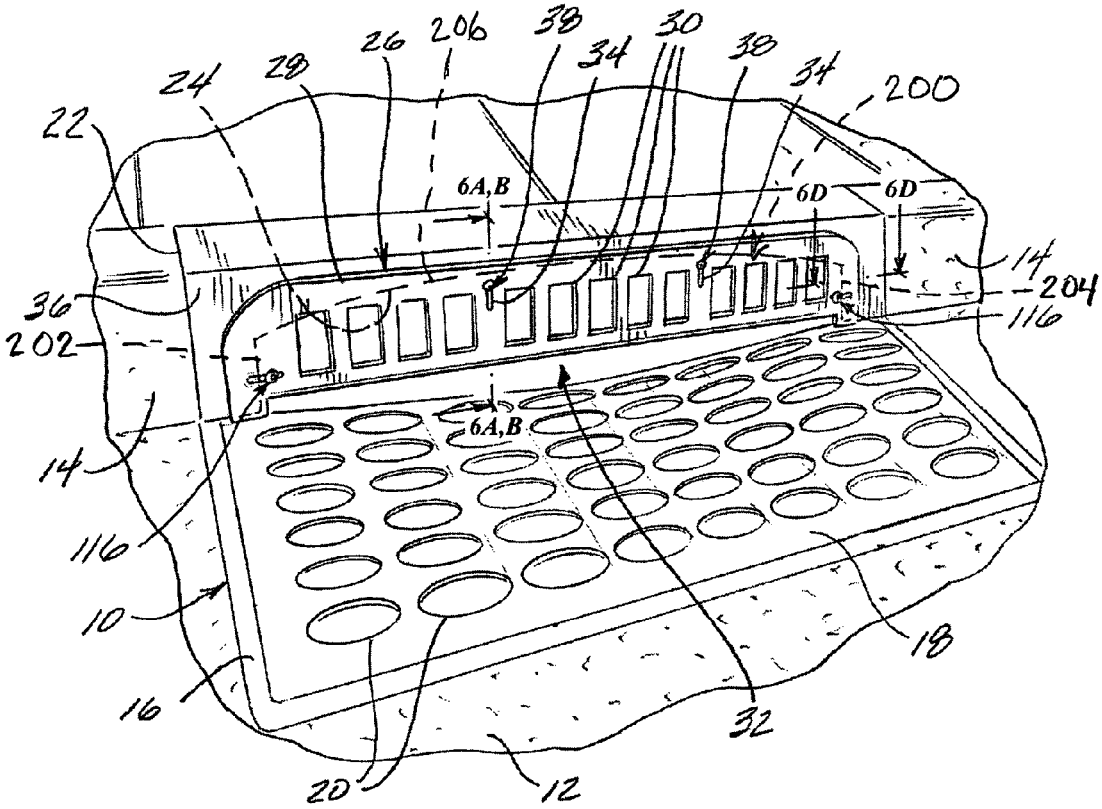
FIG. 1 is a perspective view of a catch basin box with the cover assembly of the present invention shown in place.

Refer now to FIG. 1. There is depicted a catch basin box 10 positioned in place in street 12 and curb 14 in a known manner. Catch basin frame 16 is appropriately dimensioned so as to accept a street grate 18. The latter includes a plurality of openings 20 which facilitate a discharge of the water run-off into the storm drain accessed through the catch basin box.

Figure 12A:
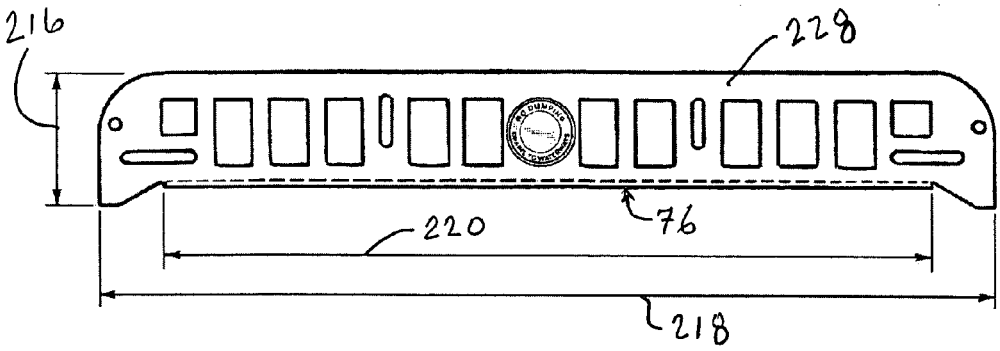
FIG. 12A is a front elevation view of a standard version of the cover of the present invention.
Figure 12B:
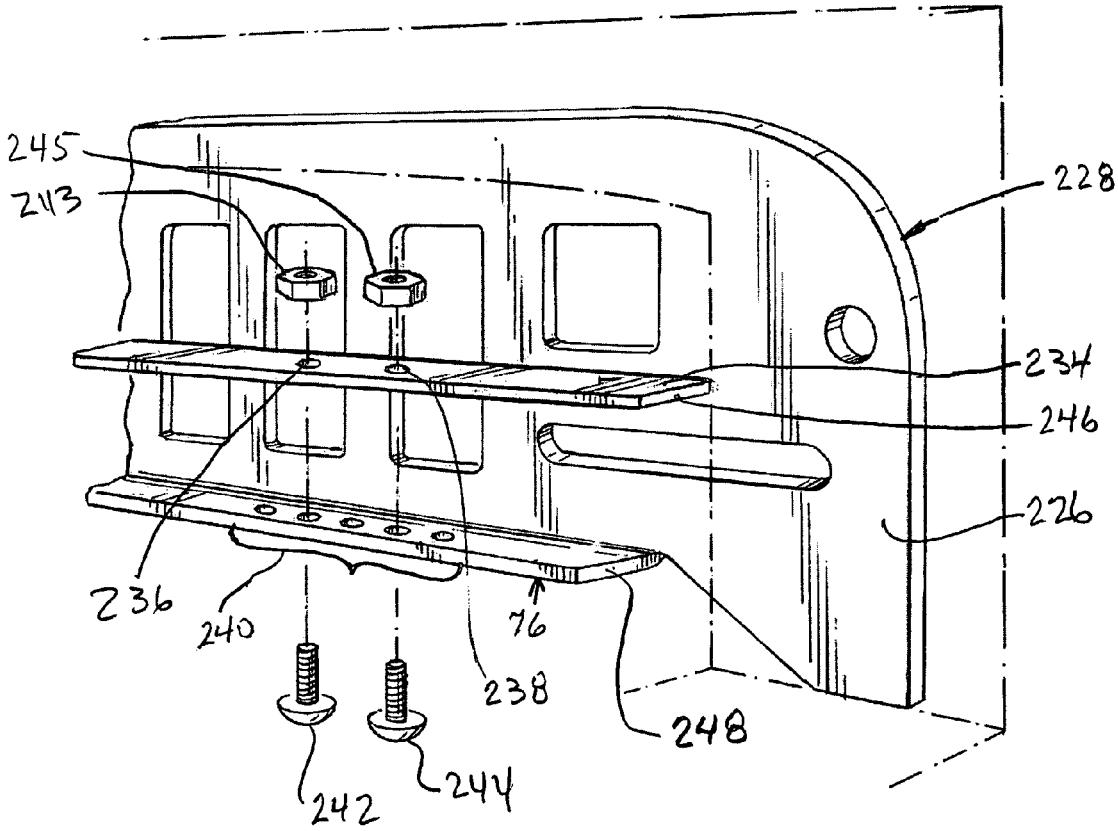
FIG. 12B is a perspective, sectional view of the cover plate of the invention with the catch basin curb inlet opening shown in dotted outline and illustrating a further feature of the present invention.
Figure 13A:
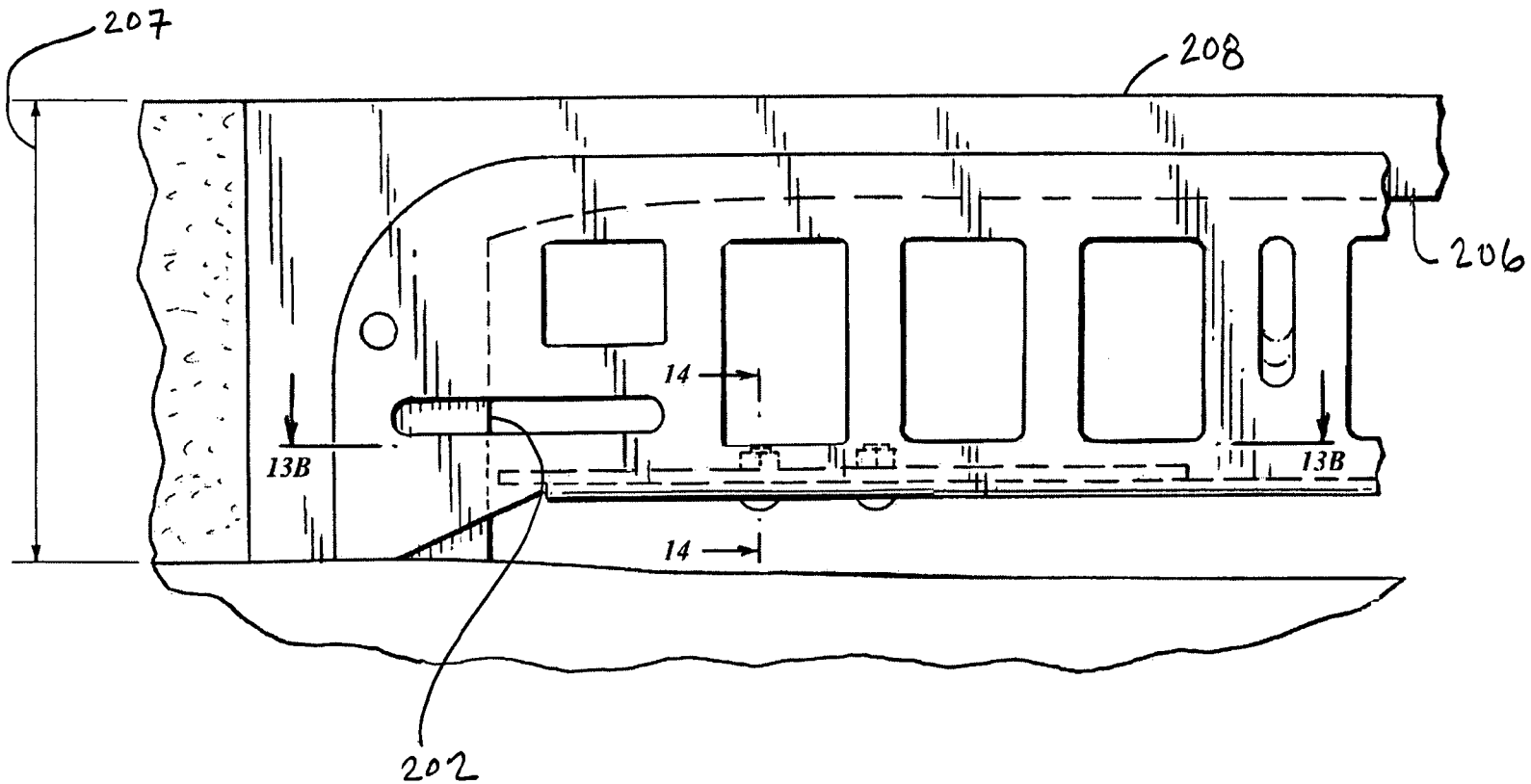
FIG. 13A is a front, elevation view of the cover plate of the present invention, in section, showing the further feature which permits the adaptation of a version of the plate of the present invention so as to enable its use with a large array of catch basin curb inlets with different opening contours.
Figure 13B:
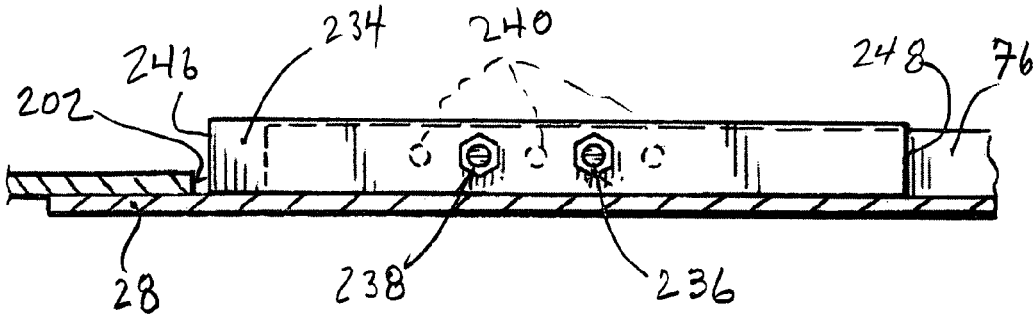
FIG. 13B is a plan view taken along lines 13B-13B of FIG. 13A.
Figure 14:
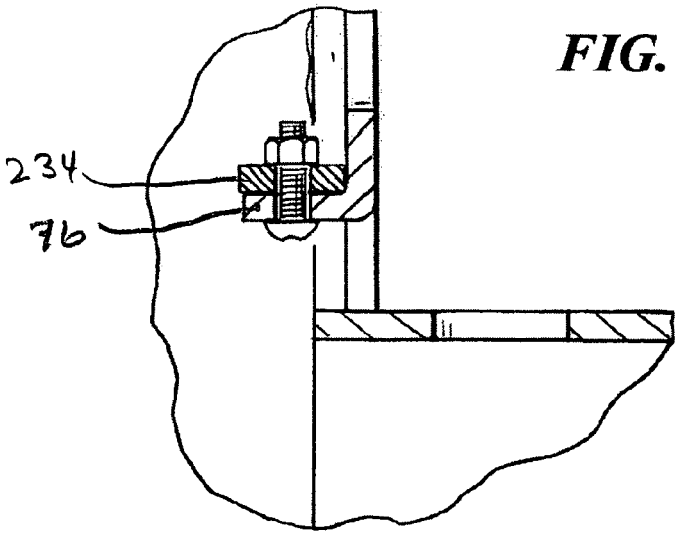
FIG. 14 is a side elevation view of the cooperative engagement of the adjusting bar member with the bend portion of the plate member taken along lines 14-14 of FIG. 13A.

A curb piece portion 22 includes a catch basin curb inlet opening 200 having a prescribed area and contour 24 which is shown dotted in FIG. 1. The opening includes a left edge 202, a right edge 204 and a top edge 206. The horizontal distance between the left and right edges will vary for different box sizes, typically over the range of 41 to 46 inches. (See FIG. 1). The curb height 207, FIG. 12, of the basic curb boxes typically is 6 inches, 8 inches or 10 inches nominal. The top edge 206 is approximately 2.0 to 2.5 inches below the top surface 208 of the curb inlet portion of the box.

The area of the street grate openings 20 and the catch basin inlet opening are sized so as to provide a sufficient area to handle the anticipated water run-off at the location of the catch basin box.

The contoured opening, for example 24, has, over the years, experienced various shapes and sizes and it is one of the primary purposes of this invention to address the myriad of openings that presently exist.

Notwithstanding, these contoured openings did not preclude the passage of cans, bottles, and other, larger sized objects from entering the catch basin and thus the storm drain system.

With increased sensitivity to the need to keep our environment free from such debris, particularly cans, bottles and the like, several products such as the present invention have been developed to provide a retrofit cover assembly for existing, in-place catch basins as a solution to the problem.

The cover assembly 26 includes a cover 28. This cover includes at least one and, typically, a plurality of first openings 30. These openings 30 are sized to maximize the flow of the water run-off and to prevent the larger objects from entering the catch basin. The dimensions of these openings are set by a controlling, regulatory agency. For example, the DOT for the State of New Jersey has provided regulations which control any one dimension of these openings 30 so as not to exceed 2 inches with the total area for any one opening to be no more than 7 inches maximum.

A second, first opening 32 may be formed in the cover 28 as a result of the strengthening and force protection adaptation made to the cover as described below. As a consequence, opening 32 assists in water run-off. Again, as depicted in FIG. 1, the vertical dimension of this opening 32 would be less than the maximum dimension required by the controlling agency.

The cover 28 also includes at least one, and typically, again, a plurality of second openings 34. Each of these second openings, if more than one, is formed in the cover 28 in a predetermined location in near proximity to the expected location of the contoured opening 24 for the particular catch basin inlet opening to be covered. The location of the second opening(s) 34 again will vary depending on the various contours that exist and which will be experienced on a given job.

The form of the first opening(s) 30 also will vary depending on the contour of the catch basin inlet opening that is to be covered. (See also FIGS. 7, 8 and 9).

In order to secure the cover 28 to the front face 36 of the curb piece portion 22, means for clamping, 38, are employed. These cooperate with the second openings, such as 34, which are preferably formed as slots, and the adjacent portions of the cover, and the interior side (not shown in FIG. 1) of the face portion 36 of the curb inlet portion of the catch basin box.

Figure 2:
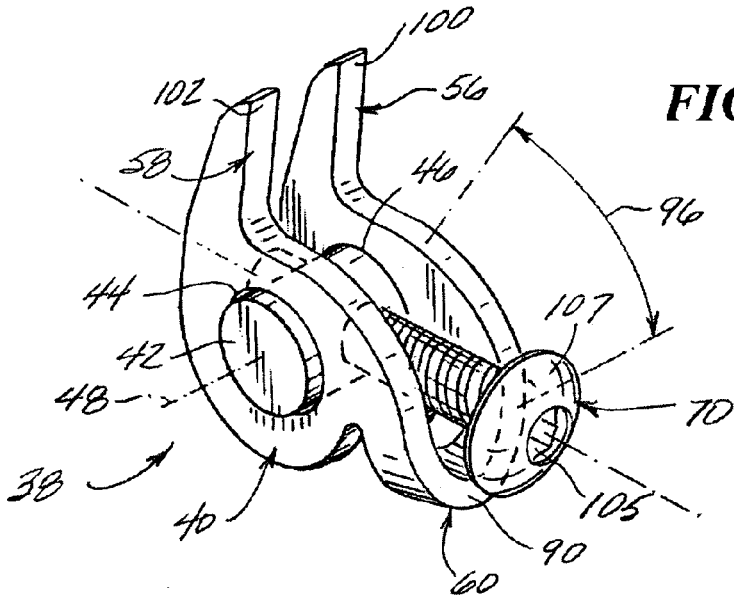
FIG. 2 is a perspective view of the means for clamping the cover, showing the assembled relationship of the components.

The number of means for clamping that are to be employed will be a quantity sufficient to adequately secure the cover 28 to the front face 36 of the catch basin. In addition to FIG. 1, refer now to FIGS. 2 and 3. In FIG. 2, the means for clamping 38 are seen to include in the preferred embodiment of the invention in the parent application, U.S. Ser. No. 11/253,893, a formed clamp member 40. The clamp member 40 is mounted on a pivot member 42. As best appreciated in FIG. 3, pivot member 42 is positioned in openings 44 and 46 which are co-axially aligned along a first axis 48 when the clamp member is formed. The pivot member includes an annular groove 50 and a threaded opening 52. The axis of the threaded opening is perpendicular to the first axis 48.

Figure 3:
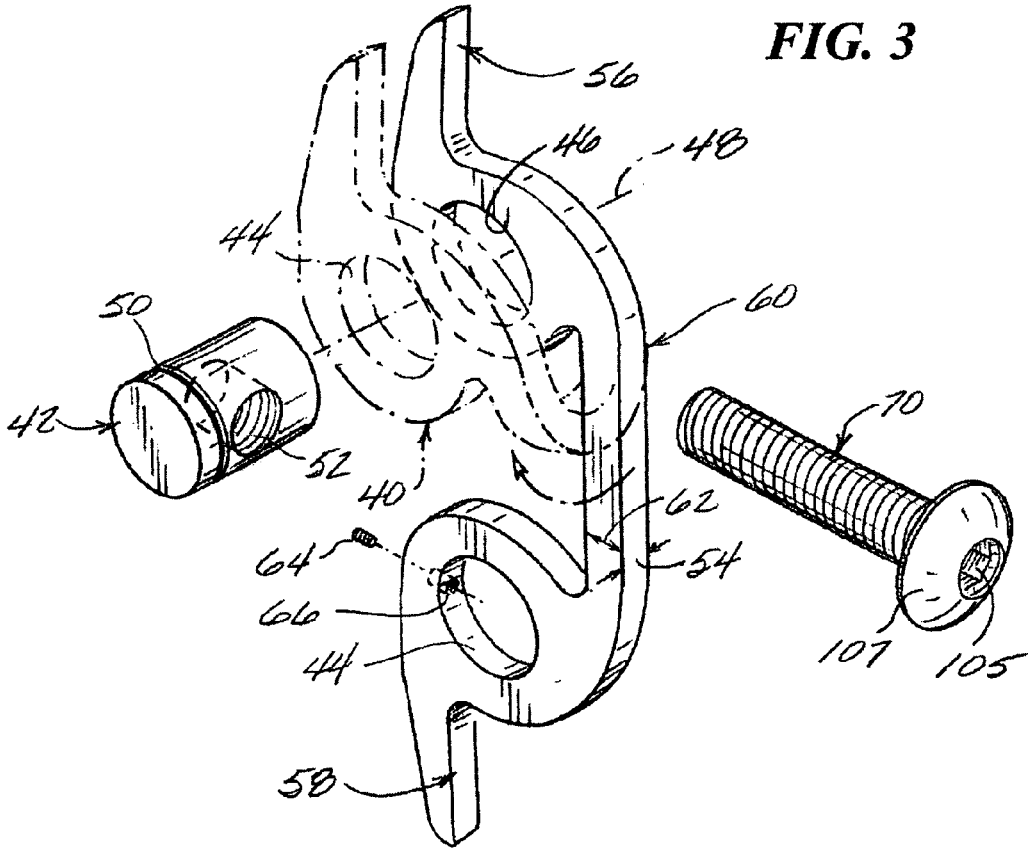
FIG. 3 is an exploded view of the means for clamping of FIG. 2 and also indicating the procedure for forming the clamp member portion of the means for clamping.

Referring to FIG. 3, the clamp member 40 is formed from a sheet of material, typically steel, which is a ¼ inch in the thickness dimension, 54. The metal sheet stock is the same as used to form the cover described below The pre-formed shape of the preferred embodiment is as shown in solid lines in FIG. 3. The cut piece includes a first and second catch basin contact member 56 and 58. These are integrally connected by a transition member 60 which is approximately ⅜ inches in the width dimension, 62.

After cutting the basic clamp member, it is then formed into its final shape by bending the piece about the transition member 60 so that openings 46 and 44 of the first and second contact members, 56 and 58, again, are co-axially aligned along the first axis 48. To complete the assembly, the pivot member 42 is then inserted into the aligned openings 44 and 46. The pivot member 42 is secured in these openings through the use of a set screw 64. This screw engages a threaded-through opening 66 in one of the contact members, for example 58, and is advanced in that opening until its tip contacts the annular groove 50 of pivot member 42. The cooperative action between the set screw and the annular groove initially prevents the pivot member from turning freely in openings 44 and 46; however, the formed clamp member 40 is able to rotate about the pivot member during the assembly operation as described below. The set screw 64 typically is made of a synthetic material such as nylon. Alternately, this screw may be made of metal with a tip fashioned of material of less hardness than that used to make the pivot member 42, again, for example, nylon.

The angular displacement (65, FIG. 6A) of the contact members 56, 58, when first assembled to the cover 28, is sufficiently positioned away from the interior surface 98 of the catch basin so as to minimize any clearance problems at point of assembly of the cover to the catch basin. This is better appreciated from FIGS. 6A and 6B. The set screw 64 cooperates with the annular groove to retain the clamp member 40 in a fixed position to the pivot member 42, again to facilitate its assembly to the cover 28 and further to assist in the assembly process needed to secure the cover to the catch basin face.

Figure 4:
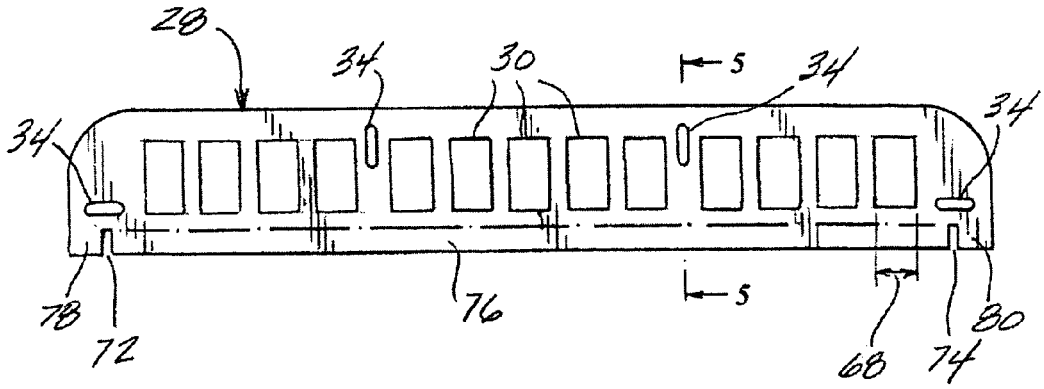
FIG. 4 is a front elevation view of the cover of the present invention as first cut from stock material.
Figure 5:
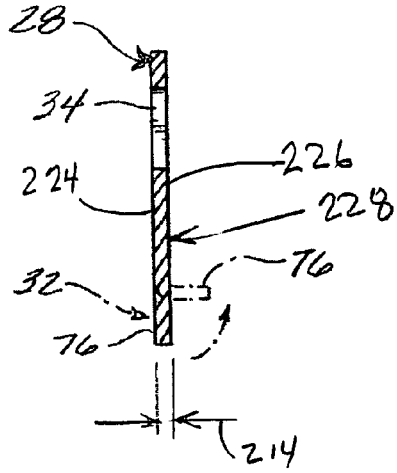
FIG. 5 is a sectional view taken along lines 5-5 of FIG. 4 and showing the finishing operation to form the cover of the present invention.

FIGS. 4 and 5 depict the forming process of one version of the cover 28. This, too, is cut from sheet metal material which is nominally ¼ inch thick. It includes at least one first opening 30, and typically a plurality of such openings which, in the embodiment depicted in FIG. 4, are a plurality of parallel openings of rectangular shape disposed in a vertical arrangement, as viewed in FIG. 4. As noted above, the dimensions of the opening(s) 30 are usually dictated by the governmental agency charged with such matters, for example the Department of Transportation in a particular state. For example, the State of New Jersey DOT requires such openings to have one dimension, for example 68, that can't exceed 2 inches maximum. This dimension will then preclude the passage of cans and bottles and other large material, thus insuring the primary purpose of these retrofit coverings. Still further, the openings must have a maximum area and an adequate number which will insure little or no impact on the required water flow rate at a particular catch basin.

The cover includes at least one, second opening 34. Typically there are a plurality of such openings which are available to secure the means for clamping previously described. The bolt member 70 (see FIGS. 2 and 3) passes through these openings 34 which are of a diameter slightly larger than the shank of the bolt 70. These can be slotted so as to compensate for tolerance build-ups in the catch basin box, the elements of the cover assembly and surveying (the field procedure used to establish the contour of a particular basin opening) errors.

Figure 8:
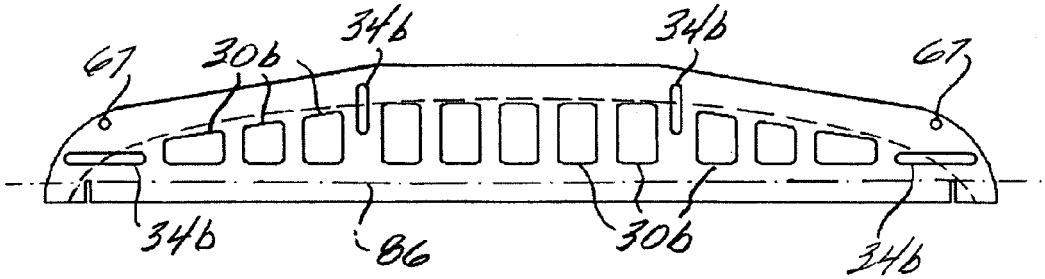
Figure 9:
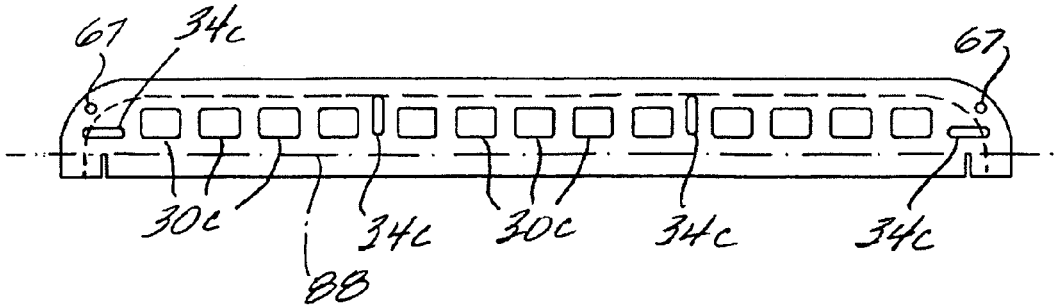

In forming the finished product, the cover of the embodiment of FIG. 4, as well as FIGS. 8 and 9, includes the cutting of slots 72 and 74. These are cut to a vertical height, as viewed in FIG. 4, to permit a bend portion 76 which is formed at typically right angles to the vertical orientation of the member 28 to strengthen the cover 28, especially if the latter is relatively thin. The second, first opening 32 is typically formed by this process and, again, further alleviates any obstructive effect on the water flow at a particular basin. This bend portion does not necessarily need to be included, for example see FIG. 9, especially for shorter length and/or thicker, covers.

Figure 7:
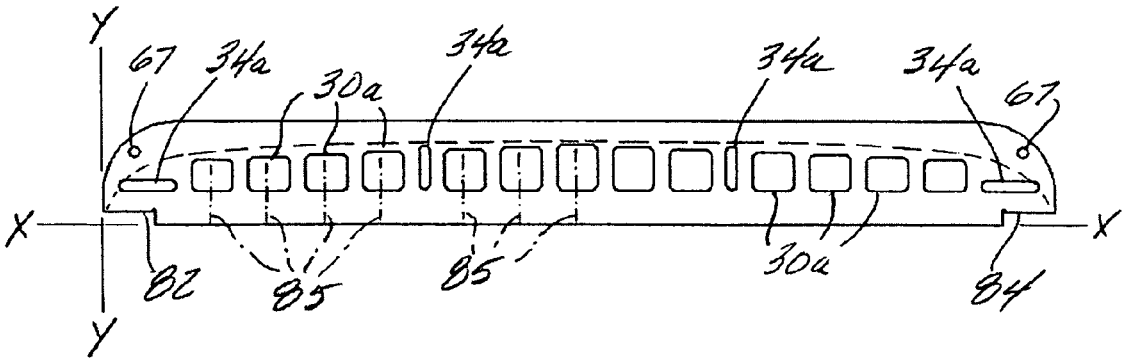
FIGS. 7, 8 and 9, are front elevation views of different covers, designed to provide the benefits of the invention for differently contoured catch basin inlet openings.

In cutting the slots and forming the bend portion 76, tabs 78 and 80 will remain as part of the cover, in the vertical plane. These act as stanchions, supporting the cover on the street grate and facilitating the assembly of the cover to the catch basin. 18. In the embodiment of FIG. 7, where the bend portion is not formed, the cover in that embodiment would rest on the grate along its entire length, or on shoulders, 82 and 84 (see FIG. 7), if the tabs, such as 78 and 82, are cut off from the particular embodiment of the cover piece. Again these variations in design accommodate the multitude of existing catch basins that can be confronted.

Further discussion of the cover as more particularly relates to the present invention follows below.

Again FIGS. 7, 8 and 9 show the configuration of the covers for different applications. The first openings, which functionally correspond to opening 30, are seen to include various sizes and shapes for any given cover embodiment. The contour for each of the catch basin inlet openings is shown for each embodiment in dashed lines. Again, the basic one dimension limitation, for example, 2.0 inches, as might be dictated by a particular DOT, remains, with the area of each opening reflective of the particular contour dimension experienced and recorded by a surveyor at the location for each basin, keeping in mind, in the design phase, the maximum, acceptable area for any one opening.

The process for determining the contour dimensions of any given embodiment, in its simplest form is established by surveyors who prepare templates for each contour of each basin that they experience in the field. The template typically need only be made of one-half of the catch basin inlet opening (the other representing the mirror image), and returned to the manufacturing facility. There measurements are taken from the template and entered into a suitably programmed computer which then provides accurately dimensioned machining drawings from which the cover can be manufactured.

It is anticipated that this process can be improved upon by taking a series of vertical measurements to the contour of the catch basin inlet opening, at various horizontal distances along the horizontal length of the catch basin. Superimposed on the cover embodiment in FIG. 7 for example, is an XY grid. The field agent would simply measure and record the vertical height to the contoured opening for each of a series of x-positions identified as 85. The heights for these positions would be returned again to the manufacturing facility where they could be inserted into a suitable computer program which would then direct the machining of a particular embodiment resulting in a customized cover suitable for that particular catch basin inlet opening. The computer program would be adapted to shape the first openings 30, 30*a*, 30*b*, 30*c*, etc. so as to take into account the vertical dimension of the contour opening at a particular x dimension, while controlling the opening area requirements as dictated by the involved agency. Second openings 34, 34*a*, 34*b*, 34*c*, etc. are also suitably located so as to facilitate the cooperative engagement of the clamping means with the catch basin surface. Simple, circular thru holes 67 can be provided for bolting the cover member to the catch basin for unusual basin opening configurations. Referring to FIGS. 8 and 9, bend lines 86 and 88 define the point of bending where the bend portion, similar to 76 in FIGS. 4 and 5, are formed.

Figure 6A:
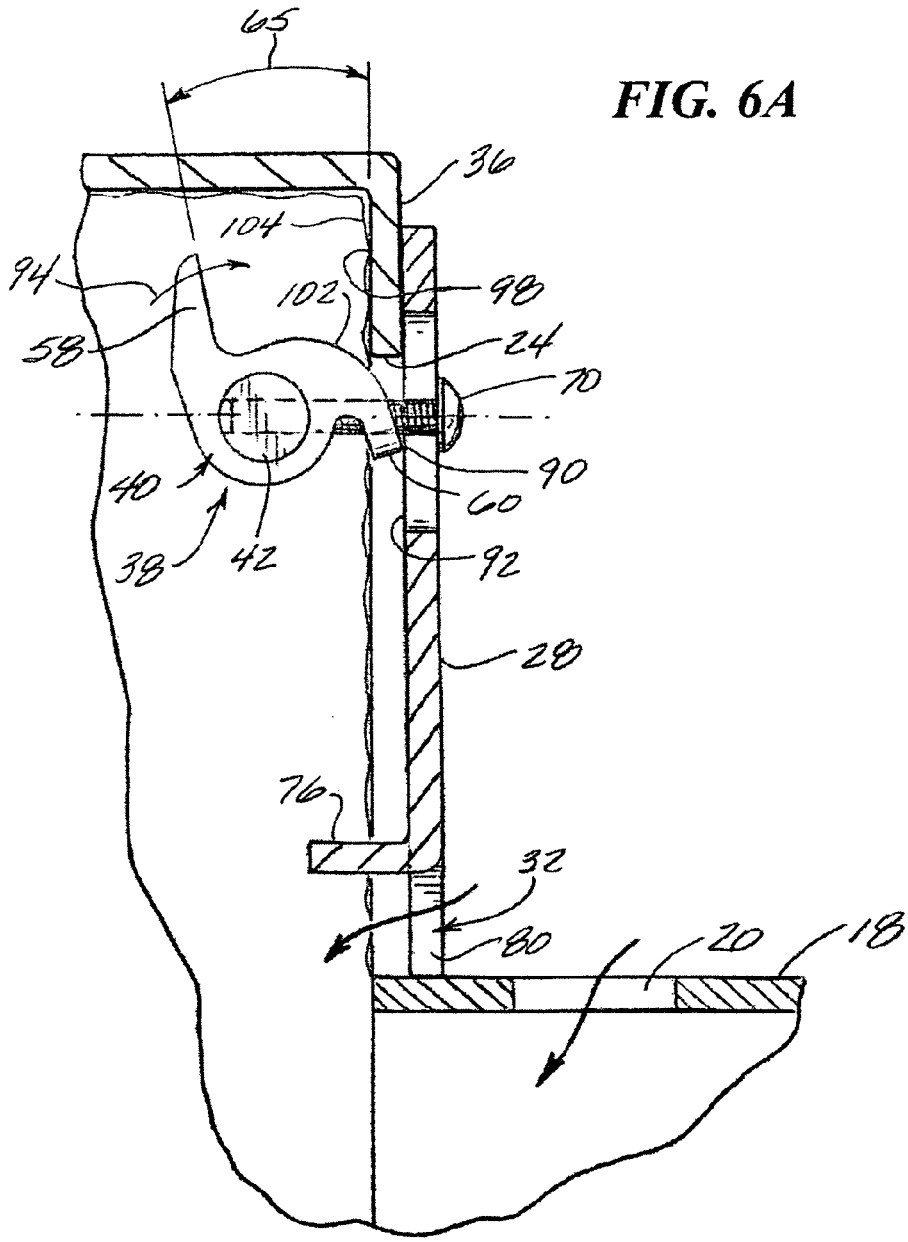
FIGS. 6A and 6B are each a side elevation view taken along lines 6-6 in FIG. 1 showing the cover in place in front of the catch basin and demonstrating the use of the means for clamping of the cover of the present invention.
Figure 6B:
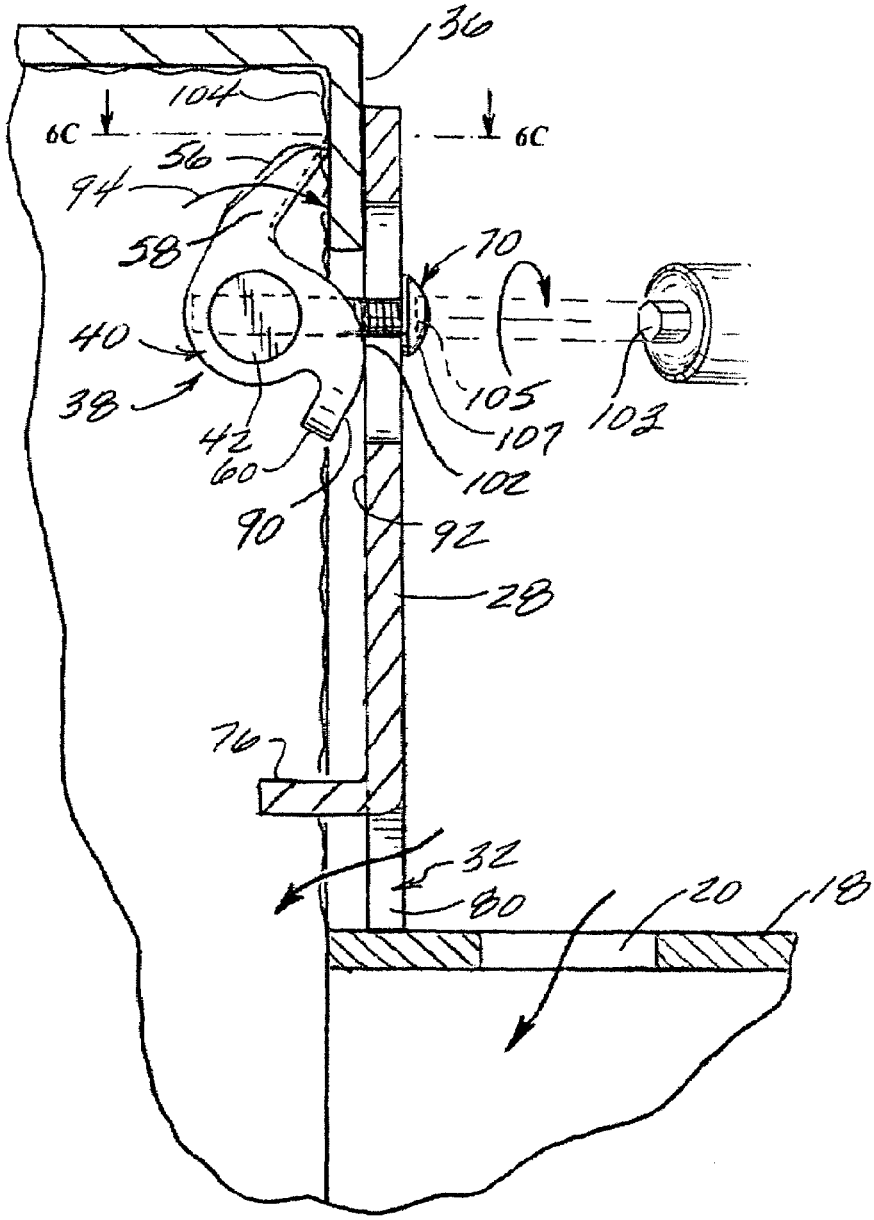
Figure 6C:
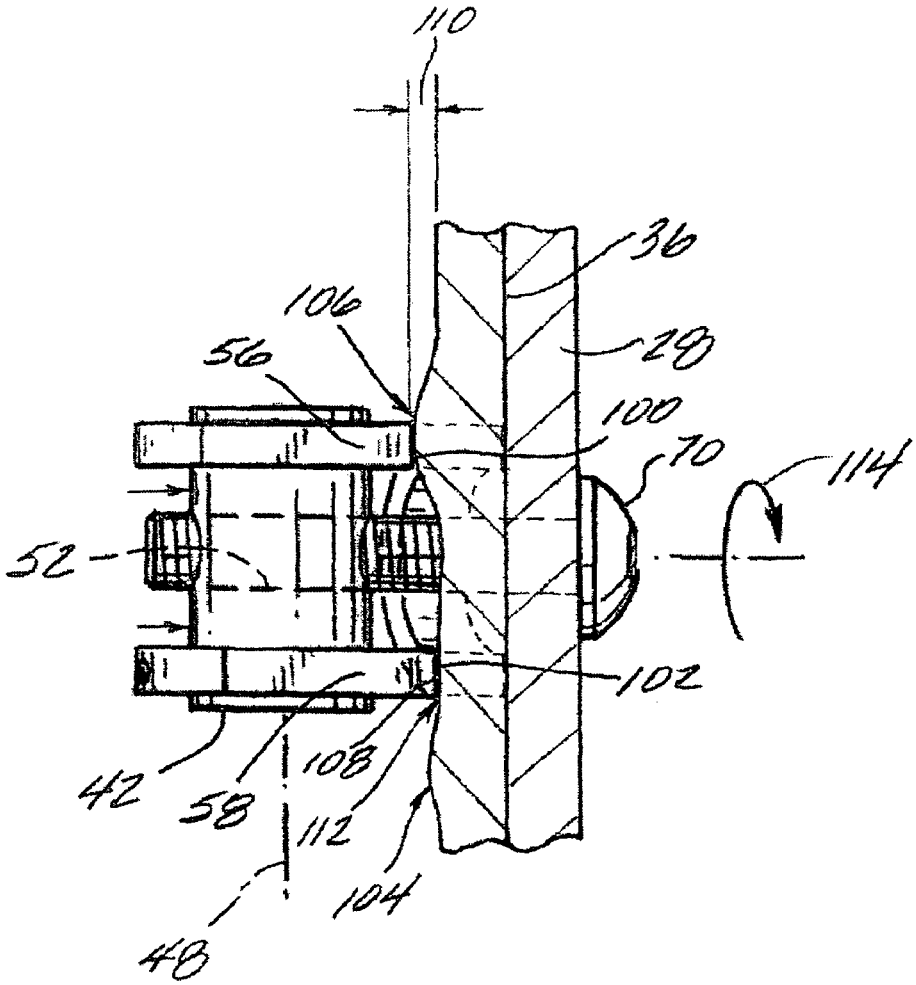
FIG. 6C is a sectional top plan view of a portion of the catch basin showing the adaptation of a portion of the means for clamping to the irregularities of the interior surface of the front face portion of the catch basin.

Refer now to FIGS. 6A, 6B and 6C. FIG. 6A depicts the means for clamping 38, assembled to the cover 28. Initially the clamp member 40, secured on the pivot member 42 is positioned behind the cover 28. This is done prior to assembly of the cover 28 to the catch basin face portion 36. The bolt 70 is inserted through the corresponding second opening 34 in the cover and then engages the threaded opening 52 of the pivot member 42. As noted above, the clamp member 40 is held in a fixed position in relationship to the pivot member 42 by sufficiently tightening down the set screw 64 on the annular groove 50 of the pivot member. The relationship between the contact members, 56(not visible) and 58, and the casting face 36 is typically as it appears in FIG. 6A at the point of initial assembly.

When first secured to the cover, as the bolt 70 is drawn up in the threaded hole by an operator, a first cover contact surface portion 90, typically located on the transition member 60 of the clamp member 40, engages the interior surface 92 of the cover 28. As the bolt is further threaded into the opening 52, the clamp member 40, leveraged by the contact between the first cover contact surface portion and the cover, rotates in the direction 94. The surface of the clamp member 40 in contact with the interior surface of the cover moves through a range 96 (see FIG. 2) until one or both of the contact members 56, 58 reach the interior surface 98 of the catch basin. Assuming a smooth interior surface 98, the respective, second cover, contact surface portions 100, 102 of the first and second contact members 56 and 58 are drawn against the interior surface 98, generally, simultaneously. The cover 28 is now secure to the face portion 36 of the catch basin (FIG. 6B).

After the bolt is tightened as necessary, it is important that vandals, or other unauthorized individuals not be able to easily remove the bolts, 70. To this end, a slug member, 103, can be provided, which is so configured so as to be force fitted into the opening 105 in the bolt head. This can be accomplished through use of a suitable tool which retains the slug as the tool is positioned in proximity to the bolt. The tool is struck and the slug is driven into the opening 105 with enough force to securely wedge it into the opening. The slug is typically fashioned from a steel grade which is somewhat softer than the bolt material. In the insertion process, the slug material flows sufficiently to fill the opening and is generally flush to the surface 107 of the bolt head.

FIG. 6C illustrates the respective engagements of contact members 56 and 58 with a typical, irregular interior surface 104 of the catch basin, curb piece face 36. As noted above, this irregularity results from the sand casting process typically employed in fabricating catch basin curb boxes. As illustrated, the respective first and second contact members, 56 and 58 will engage the irregular surface at respective portions 106 and 108 at their respective contact surfaces 100 and 102. It is not unreasonable to expect that the separation distance 110 between the two contact portions 106 and 108 of the irregular surface 104 can be as much as ¼ inch.

For the irregular surface condition depicted in FIG. 6C, contact member 56 is seen to strike the irregular surface 104 before the second of the two, 58, contacts it. However, in accordance with the principles of the invention, the continued rotation of bolt 70 in the direction indicted, 114, causes the clamp member, 40, secured to the pivot member 42 to rotate further in the contact range 96 until the second contact surface portion 102 meets the irregular surface at point 112. This ability to continue rotation even though one contact member has met the irregular surface, is facilitated by the thickness of transition member 60. The thicknesses 54 and 62 are determined, at least in part, so as to allow the two contact members 56 and 58 to in effect rotate independently when one is restrained from further rotation as illustrated in FIG. 6C.

Figure 6D:
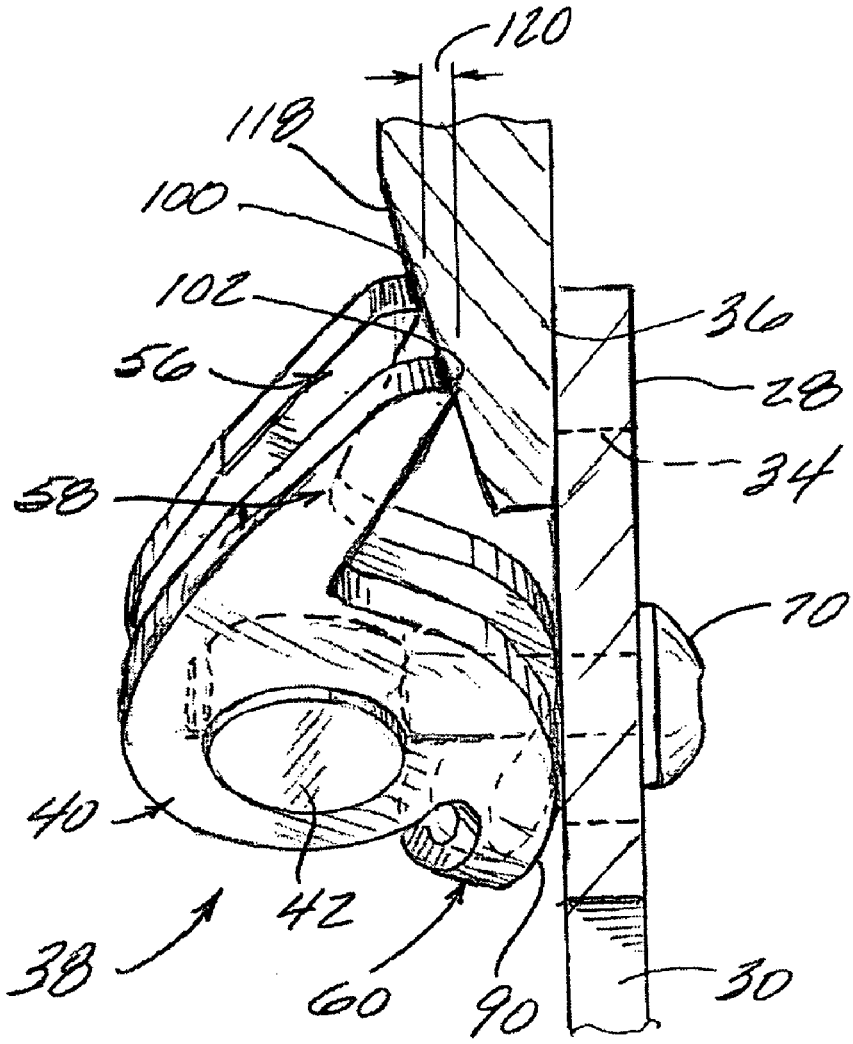
FIG. 6D is a sectional elevation view of a portion of the catch basin showing the adaptation of a portion of the means for clamping to the angularity of the interior surface of the front face portion of the catch basin.

In FIG. 6D, taken along view line 6D in FIG. 1, a unique problem is addressed which involves the horizontally disposed clamping means 116 (FIG. 1), when employed. In this regard, one other manufacturing aspect of the catch basin curb box, as illustrated in FIG. 6D, the chamfered interior surface 118, must be addressed. Because of the bevel, the difference 120 between the contact points for each of the two contact members, can be as much, again, as a ¼ inch. This is on top of the discrepancies attributable to the irregularity of the interior surface noted above, due to the casting process. Notwithstanding, the independent movement principle of the parent application allows the clamping means of the invention to easily accommodate these discrepancies ensuring a firm and secure retention of the cover in place.

The cover 28 as well as the stock material used to form the clamp member 40, is fabricated from a metal plate, preferably ¼ inch thick, of COR-TEN®A brand steel, ASTM (American Society for Testing and Materials) grade A-588, a product of United States Steel Corporation, the trademark registrant. This type steel is familiarly used for dividers, girders, and bridges and achieves a dark brown appearance after exposure to the environment.

While a preferred embodiment for the invention of the parent application has been described, the scope of that invention can not be seen as limited thereto. For example, while the formed clamp member is seen as a single piece formed from sheet metal and bent into the configuration depicted in FIGS. 2 and 3, each of the contact members, 56 and 58, can be formed individually, without a transition member, 70. These individual members could each be secured to respective annual grooves formed in pivot member 42, so that the independent movement of the two is assured.

Figure 10:
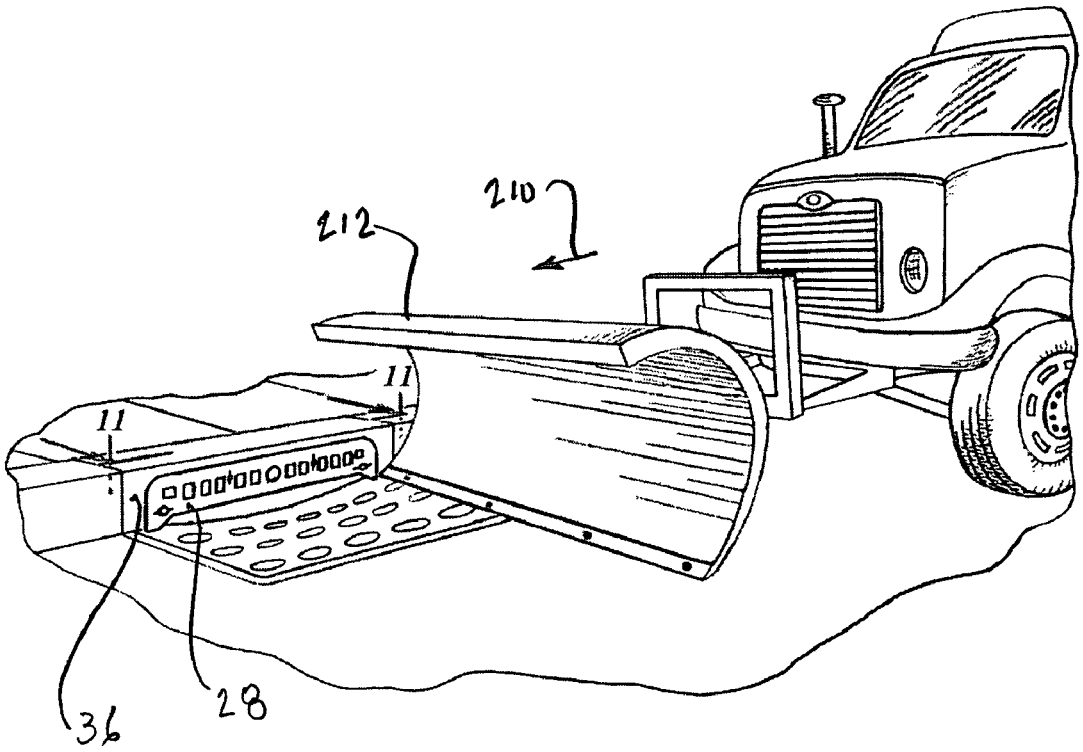
FIG. 10 is a perspective view of the cover of the present invention in place over a catch basin curb inlet and illustrates one of the problems sought to be solved by the present invention.

FIG. 10 portrays a scenario that results in a potential problem when using a cover plate 28 which is secured to the outward facing front surface 36 of the curb inlet portion of a catch basin box 10. As noted above, the thickness of the cover is approximately ¼ inches. In climates where snow is a predictable occurrence on a regular basis, of course the streets must be plowed. The driver of these vehicles will typically use the curb as a guide in plowing the streets. The plows are biased so that they back off from any obstruction it might hit as it moves along. However, at the point of contact such as with the cover 28, there will be a momentary significant horizontal force exerted on the plate. In the scenario of FIG. 10, that force would be in the direction of arrow 210.

The cover or plate member 28 of the present invention is adapted to resist the horizontal movement resulting from such forces. Returning to FIGS. 4 and 5, the cover of the present invention is seen to comprise a plate member 28 having a predetermined thickness 214 on the order of ¼ inch. As described above, for customized versions of the plate, a field survey of a particular curb inlet opening is obtained. This is used to locate and size the various openings 30, 34 and slots 72 and 74 as appropriate. By locating the slots 72 and 74, the length and location of bend portion 76 is dictated.

As noted above, oftentimes the customers for covers in accordance with the present invention may be interested in working with a set of standard sized plates as to minimize the further expense necessary to conduct field surveys. A set of standard plates for example might be designed to accommodate the 6 inch, 8 inch and 10 inch boxes mentioned above. Such a standard plate is depicted generically in FIG. 12A. The standard plates for each of the box sizes noted will have the following, typical dimensions: height, 216 would run nominally, 5 inches, 7 inches and 8.75 inches, respectively; the length 218 again nominally, would be 48 inches, 48 inches and 49.5 inches, respectively; and, the length 220 of the bend portion or further segment 76 would be 41 inches, 41 inches and 43 inches, respectively.

In general, the length and height of the plate member 28, for either the customized version or the standard sized versions, will be of sufficient dimension such that the plate member extends beyond the left edge, right edge and top edge of the curb inlet opening 200 so as to cover the entire area of the inlet opening when the plate member is positioned in its intended place juxtaposed to the outward facing front surface 36 and secured for example in the manner described above, to the catch basin box.

Returning again to FIG. 4 and FIG. 5, the plate member or cover 28 includes a first or up-water surface 224 and a second or down-water surface 226 parallel to the first surface and separated therefrom by the plate thickness 214, typically, again, ¼ inch.

Figure 11:
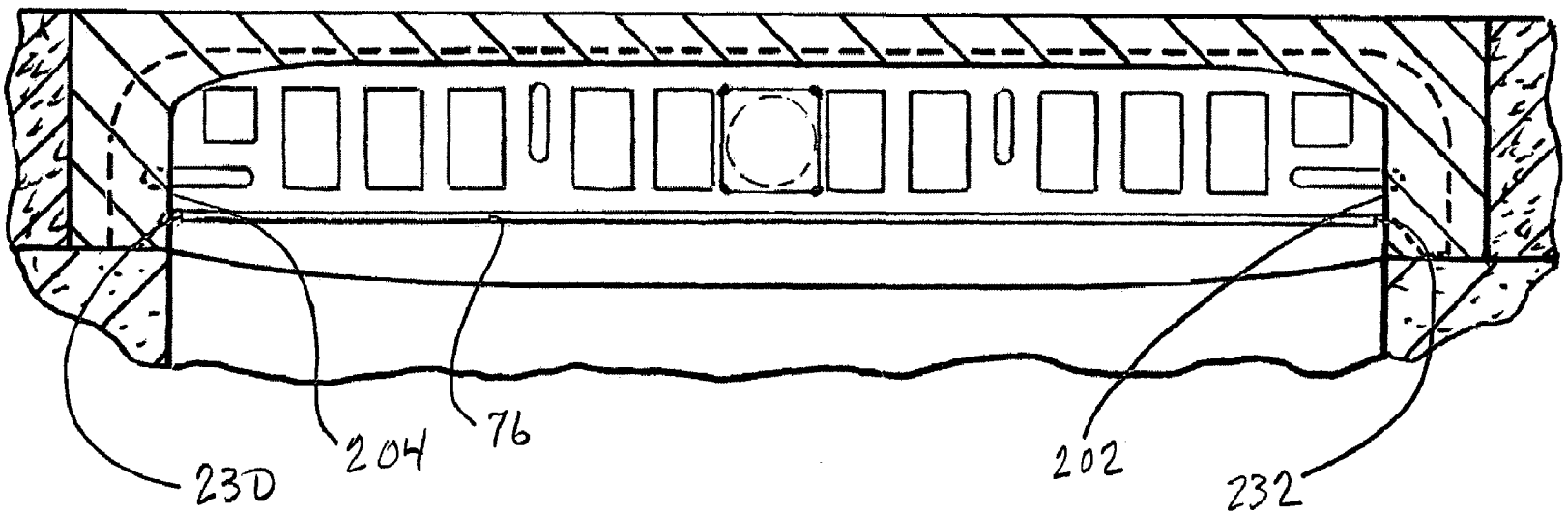
FIG. 11 is a rear elevation view of a customized version of the plate of the present invention cooperating with the vertical edges of the catch basin inlet to provide resistance to any horizontal contact forces exerted on the plate.

The plate member or cover includes a main segment 228 and the further segment or bend portion 76. In the customized version of the plate, the surveyed field measurements are used to machine and then form the cover such that a respective surface, for example, 230 and 232 (see FIG. 11) is in sufficiently close proximity (approximately ¼ inch) to the right and left edges 204 and 202 of the curb inlet opening, such that the cover 28 is restrained in its movement horizontally, in either direction, by the engagement of one of the surfaces 230 or 232 and its corresponding facing edge 204 or 202.

FIGS. 12B, 13A, 13B, and 14, help to illustrate a means for adjusting the horizontal length of the further segment or bend portion 76. This ability to adjust the length of 76 accommodates the standard sets of covers noted above which can be used as an alternative to the customized version of a plate.

As with the customized version, the bend portion 76 is formed. The means for adjusting the length of the further segment or bend portion 76 include a bar member 234 which includes a pair of alignment holes 236 and 238. The bend portion 76 extends approximately 1½ inches behind the down-water or second surface 226 of the main segment 228. The bend portion 76 includes a set of alignment thru holes 240.

The bar member 234 is secured to the bend portion by aligning the holes 236 and 238 with two of the set of thru holes 240 and securing the two together using a pair of button head, socket cap ⅜-16×1 inch screws, 242 and 244 and complementing zinc plated nuts 243 and 245.

The bar member is typically made from the same sheet stock as the plate. It is ¼ inch thick, 1 inch in width and 12 inches long. The two holes on the bar member are typically on 2 inch centers. The set of holes 240 are on 1 inch centers. The aligning holes on the bar member and the set of holes on the bend portion are set at prescribed distances from their respective ends 246 and 248. The spacing between the holes and the distance from their respective ends are designed to enable the bar member to effectively adjust the length of the bend portion 76 by ½ inch increments by alternating which end of the bar faces the respective edge of the curb inlet opening. So, for example, referring to FIG. 13B, hole 238 might be located 4.75 inches from the end 246, while hole 236 is located 5.25 inches from end 248. With this capability, the operator is able to adjust the length of the further segment or bend portion so as to position the surface 246 in sufficiently close proximity to edge 202, again, to enable the plate member to resist horizontal displacement due to an externally applied horizontal force so as not to be dislodged from its intended position.

Figure 15:
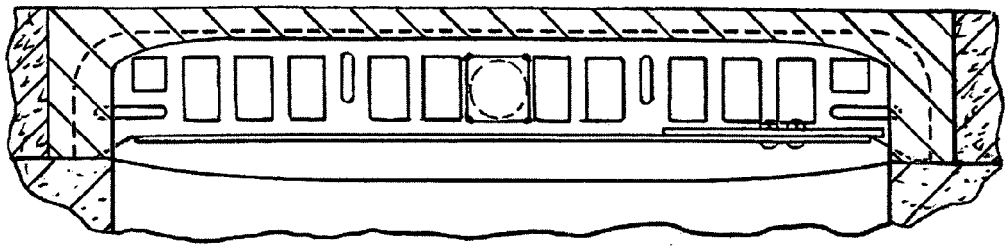
FIGS. 15, 16 and 17 are rear elevation views of standard versions of the plate of the present invention showing different arrangements of the adjusting bar member(s) and its relationship to the vertical edges of the catch basin inlet, shown in section, so as to provide resistance to the horizontal contact forces exerted on the plate.
Figure 16:
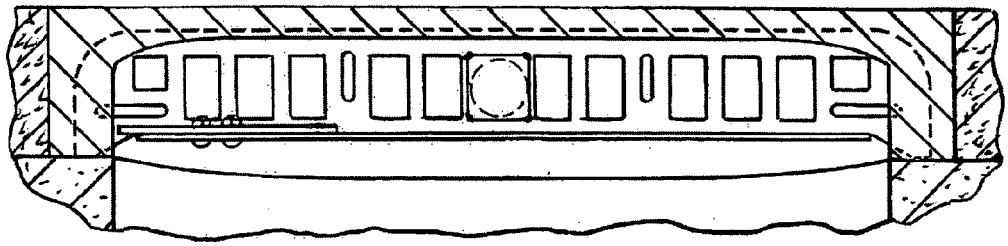
Figure 17:
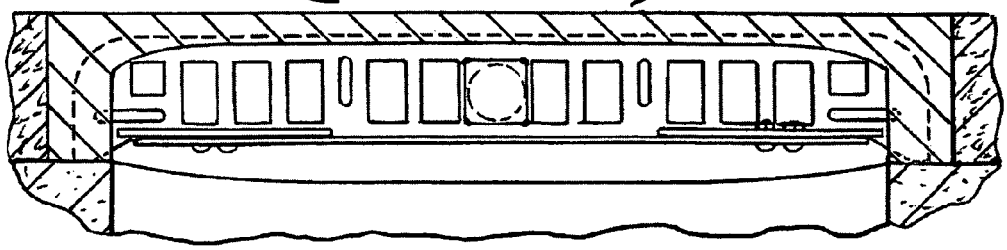

FIGS. 15, 16 and 17 illustrate the placement of the adjusting bar as a function of the anticipated horizontal forces to be exerted on the plate and as indicated by the arrow direction for each figure. The embodiment of FIG. 17 allows for the inclusion of two adjusting bars in those circumstances where it would be reasonable to assume that external horizontal forces could occur in either direction. The bend portion 76 would include two sets of aligning holes 240, one set at either end, to allow for this possibility.

Figure 18:
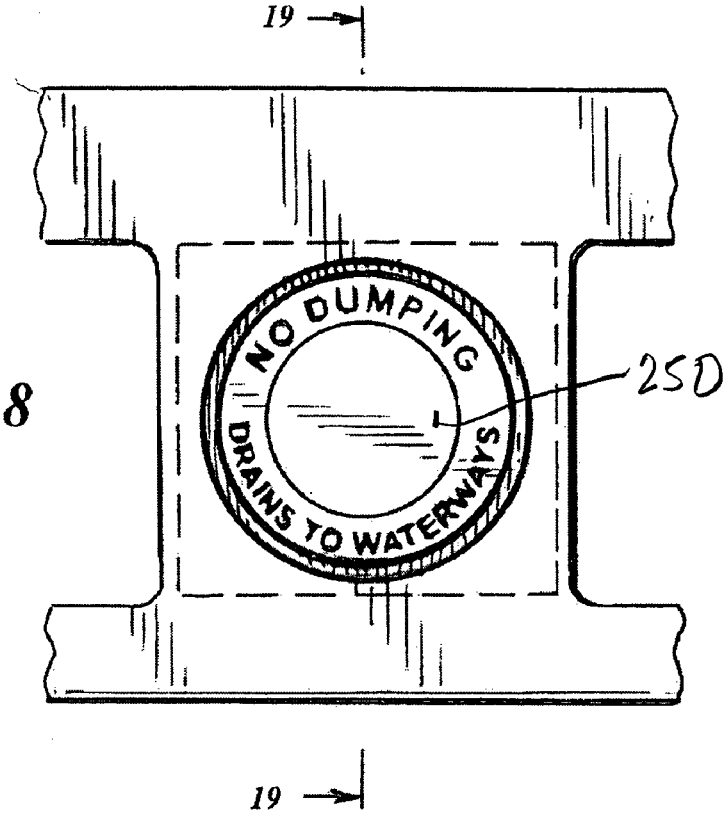
FIG. 18 is a front elevation view of a portion of the plate member of the present invention showing a precautionary badge positioned behind a suitable opening in the plate member to allow its viewing.
Figure 19:
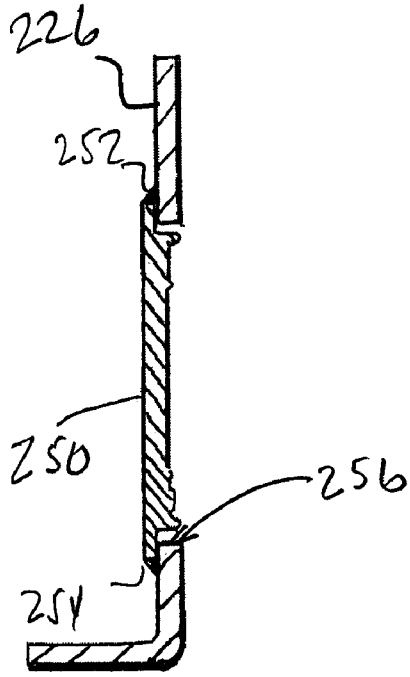
FIG. 19 is a view taken in the direction of lines 19-19 of FIG. 18.

FIGS. 18 and 19 illustrate a further advantage of the present invention. In these figures, there is depicted a precautionary badge 250. FIG. 19 shows how the badge is welded at 252 and 254 to the second or down-water surface 226 of the plate member. A further opening 256 is made in the plate or cover to permit the viewing of the badge. The welding of the badge on the back of the plate is accomplished at the plant and not in the field. Considerable savings and labor are effected as well as the significant enhancement of the durability of the badge placement particularly when contrasted with existing techniques that rely on adhesively backed badges secured to the external face of the plate or the top surface of the catch basin box.

While a preferred embodiment has been described, it should now be apparent that alternative ways of implementing the present invention are suggested. For example, although the further segment comprises the bend portion of the plate, it is within the scope of the invention that a separate bar-like member be welded to the back of the plate for example in the embodiment of the plate depicted in FIG. 7 where no such bend portion exists. The bar member as welded to the plate would otherwise have the relevant important dimensions of the bend portion so as to co-act with the left and/or right edges of the curb inlet opening to provide the resistance to horizontal forces. An adjusting bar(s) could also be used with this version. Alternatively, the further segment could comprise vertically disposed bars at either end of the plate member which, once again, would co-act with their respective edge of the curb inlet opening to provide the desired results.

Other adaptations are envisioned, all within the scope of the invention as defined in the following claims.

What is claimed is:

1. A catch basin assembly comprising:

(a) a curb inlet member, said curb inlet member having a curb inlet opening, said curb inlet opening having an outward facing front surface, said curb inlet opening having a prescribed area and contour dimensions, the opening including a left edge, right edge and a top edge, the left edge disposed at a certain horizontal distance from the right edge; and (b) a plate member made from a predetermined material, and having a predetermined thickness in the direction of a first axis, length and height, said plate member having a first surface and a second surface parallel to said first surface and separated from said first surface by said predetermined thickness, the length and height of said plate member of sufficient dimension such that the plate member extends beyond the left edge, right edge and top edge of said curb inlet opening so as to cover the entire area of said curb inlet opening when said plate member is positioned in place in front of said curb inlet opening with said second surface juxtaposed to the outward facing front surface, said predetermined material and said predetermined thickness such that said plate member is substantially inflexible in the direction of said first axis, said plate member including the following, (i) a main segment having at least one first opening whereby fluid may pass through said at least one first opening into said curb inlet opening, and, (ii) a further segment having a most distal left side surface and a most distal right side surface, secured to said main segment, said further segment having an overall length between said most distal left side surface and said most distal right side surface less in dimension than the certain horizontal distance between the left edge and the right edge of said curb inlet opening, such that when said further segment is inserted into said curb inlet opening there is no physical interference with the left edge and right edge when said plate member is positioned in place in front of said curb inlet opening, said further segment located on said main segment such that said respective most distal left side surface or said most distal right side surface of said further segment is in sufficiently close proximity to at least one of the group consisting of the left edge or the right edge of the contour of said curb inlet opening, whereby if said plate member were subjected to a force otherwise sufficient to horizontally displace said plate member when said plate member is in place in front of said curb inlet opening with said second surface juxtaposed to the outward facing front surface, said plate member will resist horizontal movement due to the engagement of said respective most distal left or right side of said further segment and said at least one of the group consisting of the left edge or the right edge of the contour of said curb inlet opening such that said plate member remains substantially positioned in place when said plate member is otherwise secured to said catch basin.

2. The catch basin assembly claimed in claim 1 wherein said further segment comprises a bend portion.

3. The catch basin assembly claimed in claim 2 wherein said main segment includes at least two stanchion segments for supporting the plate member during the assembly of the plate member to the catch basin.

4. The catch basin assembly claimed in claim 3 wherein said main segment includes a further opening, said further opening adapted to permit the viewing of a precautionary badge when the precautionary badge is secured to the second surface of said plate member.

5. The catch basin assembly claimed in claim 1 wherein said main segment includes at least two stanchion segments for supporting the plate member during the assembly of the plate member to the catch basin.

6. The catch basin assembly claimed in claim 1 wherein said main segment includes a further opening, said further opening adapted to permit the viewing of a precautionary badge when the precautionary badge is secured to the second surface of said plate member.

7. The catch basin assembly claimed in claim 1 wherein said further segment has a certain horizontal length, said plate member including means for adjusting said certain horizontal length so that the distance from said respective most distal left or right side surface of said further segment to at least one of the group consisting of the left edge or the right edge of the contour of said curb inlet opening is adjustable so as to enable the plate member to be used with catch basin curb inlets having catch basin curb inlet openings of different prescribed areas and contour dimensions.

8. The catch basin assembly claimed in claim 7 wherein said main segment includes at least two stanchion segments for supporting the plate member during the assembly of the plate member to the catch basin.

9. The catch basin assembly claimed in claim 8 wherein said main segment includes a further opening, said further opening adapted to permit the viewing of a precautionary badge when the precautionary badge is secured to the second surface of said plate member.

10. The catch basin assembly claimed in claim 2 wherein said bend portion has a certain horizontal length, said plate member including means for adjusting said certain horizontal length so that the distance from said respective most distal left or right side surface of said bend portion to at least one of the group consisting of the left edge or the right edge of the contour of said curb inlet opening is adjustable so as to enable the plate member to be used with catch basin curb inlets having catch basin curb inlet openings of different prescribed areas and contour dimensions.

11. The catch basin assembly claimed in claim 10 wherein said main segment includes at least two stanchion segments for supporting the plate member during the assembly of the plate member to the catch basin.

12. The catch basin assembly claimed in claim 11 wherein said main segment includes a further opening, said further opening adapted to permit the viewing of a precautionary badge when the precautionary badge is secured to the second surface of said plate member.

13. A catch basin assembly comprising:

(a) a curb inlet member, said curb inlet member having a curb inlet opening, said curb inlet opening having an outward facing front surface, said curb inlet opening having a prescribed area and contour dimensions, the opening including a left edge, right edge and a top edge, the left edge disposed at a certain horizontal distance from the right edge; and, a plate member made from a predetermined material, and having a predetermined thickness in the direction of a first axis, length and height, said plate member having a first surface and a second surface parallel to said first surface and separated from said first surface by said predetermined thickness, the length and height of said plate member of sufficient dimension such that the plate member extends beyond the left edge, right edge and top edge of the said curb inlet opening so as to cover the entire area of the said curb inlet opening when said plate member is positioned in place in front of said curb inlet opening with said second surface juxtaposed to the outward facing front surface, said predetermined material and said predetermined thickness such that said plate member is substantially inflexible in the direction of said first axis, said plate member including the following, (i) a main segment having at least one first opening whereby fluid may pass through said at least one first opening into said curb inlet opening, and, (ii) a bend portion having a most distal left side surface and a most distal right side surface, said bend portion having an overall length between said most distal left side surface and said most distal right side surface less in dimension than the certain horizontal distance between the left edge and the right edge of said curb inlet opening, such that when said bend portion is inserted into said curb inlet opening there is no physical interference with the left edge and right edge when said plate member is positioned in place in front of said curb inlet opening with said second surface juxtaposed to the outward facing front surface, said bend portion located on said main segment such that said respective most distal left or right side surface of said bend portion is in sufficiently close proximity to at least one of the group consisting of the left edge or the right edge of the contour of said curb inlet opening, whereby if said plate member were subjected to a force otherwise sufficient to horizontally displace said plate member when said plate member is in place in front of said curb inlet opening with said second surface juxtaposed to the outward facing front surface, said plate member will resist horizontal movement due to the engagement of said respective most distal left or right side surface of said bend portion and said at least one of the group consisting of the left edge or the right edge of the contour of said curb inlet opening such that said plate member remains substantially positioned in place, when said plate member is otherwise secured to said catch basin, said main segment including at least two stanchion segments for supporting the plate member during the assembly of the plate member to the catch basin, said stanchion segments formed when said bend portion is formed by deforming a respective section of said main segment.

14. The catch basin assembly claimed in claim 13 wherein said main segment includes a further opening, said further opening adapted to permit the viewing of a precautionary badge when the precautionary badge is secured to the second surface of said plate member.

15. The catch basin assembly claimed in claim 14 wherein the plate member is made from ASTM grade A 588 steel.

16. The catch basin assembly claimed in claim 13 wherein said bend portion has a certain horizontal length, said plate member including means for adjusting said certain horizontal length so that the distance from said respective most distal left or right side surface of said bend portion to at least one of the group consisting of the left edge or the right edge of the contour of said curb inlet opening is adjustable so as to enable the plate member to be used with catch basin curb inlets having catch basin curb inlet openings of different prescribed areas and contour dimensions.

17. The catch basin assembly claimed in claim 16 wherein the plate member and said means for adjusting are made from ASTM grade A 588 steel.

18. The catch basin assembly claimed in claim 13 wherein the plate member is made from ASTM grade A 588 steel.

* * * * *